United States Patent [19]

Born et al.

[11] Patent Number: 4,839,069

[45] Date of Patent: Jun. 13, 1989

[54] OLEFIN POLYSULFIDE COMPOSITIONS THEIR MANUFACTURE AND USE AS ADDITIVES FOR LUBRICANTS

[75] Inventors: Maurice Born, Nanterre; Lucienne Briquet, Rueil Malmaison; Jacques Lallement, Aubervilliers; Guy Parc, Rueil Malmaison, all of France

[73] Assignee: Institut Francais du Petrole, Rueil-Malmaison, France

[21] Appl. No.: 109,006

[22] Filed: Oct. 16, 1987

[51] Int. Cl.[4] ..... C10M 135/00; C10M 159/12

[52] U.S. Cl. ..... 252/45; 568/18; 568/21

[58] Field of Search ..... 252/45; 568/18, 21

[56] References Cited

U.S. PATENT DOCUMENTS

| | | | |
|---|---|---|---|
| 2,708,199 | 5/1955 | Eby | 252/45 |
| 2,744,070 | 5/1956 | Baker et al. | 252/45 |
| 3,022,351 | 2/1962 | Mihm | 568/26 |
| 3,471,404 | 10/1969 | Myers | 252/45 |
| 3,663,624 | 5/1972 | Jones | 260/609 R |
| 3,873,454 | 3/1975 | Horodysky | 252/45 |
| 3,925,414 | 12/1975 | Landis et al. | 252/45 |
| 3,994,979 | 11/1976 | Warner | 568/26 |
| 4,204,969 | 5/1980 | Papay et al. | 252/45 |
| 4,645,610 | 2/1987 | Born et al. | 252/45 |

OTHER PUBLICATIONS

Condensed Chemical Dictionary, Tenth Edition, p. 652.

Braid et al., "Synthesis, Structure, and Additive Properties of a Novel Macrocyclic Polydisulfide," Symposium on Additives in Fuels and Lubricants Presented Before the Division of Petroleum Chemistry, Inc., American Chemical Society, San Francisco Meeting, Aug. 29--Sep. 3, 1976.

*Primary Examiner*—William R. Dixon, Jr.
*Assistant Examiner*—Jerry D. Johnson
*Attorney, Agent, or Firm*—Millen & White

[57] ABSTRACT

Compositions of olefin polysulfides having an increased solubility in mineral oils and in synthetic oils, particularly of the hydrogenated polyalphaolefin (P.A.O.) type, are disclosed.

They are prepared more particularly by reacting a sulfur monochloride with a monoolefin (e.g. isobutene) so as to form an addition product, called an adduct, which is then reacted with an alkali metal or ammonium polysulfide, obtained, for example, by reacting a mercaptan with an alkali hydroxide or ammonia in the presence of elemental sulfur. These compositions of olefin polysulfides can be used as extreme-pressure additives in gear-oils or in metal-working oils.

15 Claims, No Drawings

OLEFIN POLYSULFIDE COMPOSITIONS THEIR MANUFACTURE AND USE AS ADDITIVES FOR LUBRICANTS

The invention relates to the field of sulfur-containing organic additives, used in particular for improving the extreme-pressure properties of lubricants. More particularly it relates to new products of the olefin polysulfide type, their manufacture and use as additives for mineral or synthetic lubricants.

BACKGROUND OF THE INVENTION

A number of processes having as an object the preparation of olefin polysulfides for use as extreme-pressure additives for lubricants are disclosed in the prior art.

In particular, U.S. Pat. Nos. 3,471,404 and 3,697,499, disclose a process comprising the following main steps of:

(1) reacting sulfur monochloride with an excess of olefin having 2 to 5 carbon atoms in the molecule, particularly isobutene, at a temperature of 20°-80° C., so as to form an "adduct", (2) reacting said adduct, obtained in the first step, with an alkali metal sulfide (preferably sodium sulfide) and elemental sulfur, used in a proportion of 1.8-2.2 moles of metal sulfide per gram-atom of sulfur, the proportion of alkali metal sulfide being of 0.8-1.2 mole per mole of adduct, and the reaction being performed in the presence of an alcohol or of a hydro-alcoholic solvent, at reflux, and (3) reacting the obtained product, which contains 1-3% of chlorine, with an inorganic base in aqueous solution, at reflux, until the residual chlorine content of the product is lower than 0.5%.

These prior patents mention a sulfur content of the obtained products which might amount to 40-60% by weight. In fact it is mostly close to 46% by weight.

These products may be used as extreme-pressure additives for lubricating oils, transmission fluids or greases, the considered lubricating bases consisting of mineral oils and certain synthetic oils.

Furthermore, U.S. Pat. No. 4,204,969 discloses a rather similar process for preparing olefin polysulfides for use as extreme-pressure additives in lubricating oils. This process comprises the following main steps of:

(1) reacting sulfur monochloride, at about 30°-100° C., with a $C_3$-$C_6$ aliphatic monoolefin (generally isobutene), preferably in the presence of a promoter consisting of a lower alcohol, so as to form an "adduct", (2) reacting said adduct with sulfur and sodium sulfide (prepared for example from NaOH, NaHS and/or $H_2S$), in a proportion of 0.1-0.4 gram-atom of sulfur per mole of sodium sulfide, in a hydroalcoholic medium, at a temperature ranging from 50° C. to reflux temperature, and recovering the obtained product without treatment by means of a base.

In the unique example of this patent, the indicated value of sulfur content is 49% by weight and that of viscosity at 37.8° C. (100° F.) is 8.6 $mm^2/s$ (cSt).

When, according to the processes of the prior art, it is desired to increase the sulfur content of the additives by using an increased amount of elemental sulfur in proportion of the alkali sulfide or hydrogenosulfide, the obtained products are insufficiently soluble in synthetic lubricating oils (e.g of polyalphaolefin type) or even in mineral oils, to be used as extreme-pressure additives.

Moreover, the kinematic viscosity of the obtained products is generally too high.

French patent applications Nos. 2 563 231 and 2 571 380, considered as a whole, or the European patent application No. 159 936, disclose a process for preparing olefin polysulfides, substantially defined by the following steps of:

(1) reacting at least one compound selected from sulfur monochloride and dichloride with at least one monoolefin having from 2 to 5 carbon atoms (generally isobutene) in a proportion of 1.5-2.5 moles of monoolefin per mole of sulfur monochloride and/or dichloride, thus forming an addition product called "adduct", (2) contacting said adduct with at least one hydrocarbyl halide selected from chlorides, bromides and iodides of $C_1$-$C_{12}$ alkyls, $C_5$-$C_{12}$ cycloalkyls or substituted cycloalkyls and $C_6$-$C_{12}$ arylalkyls or substituted arylalkyls, the amount of said hydrocarbyl halide corresponding to 1-70%, in halogen gram-atoms, in proportion to the number of halogen gram atoms of the aggregate amount of said adduct and said hydrocarbyl halide (i.e. 0.015-1.9 halogen gram-atom per 100 g of adduct), with at least one sulfur compound selected from alkali metal sulfides, hydrogenosulfides and polysulfides of ammonium or alkaline-earth metals, used in a proportion of about 0.4-0.8 mole per halogen gram-atom containing in the aggregate amount of adduct and hydrocarbyl halide, and a proportion of elemental sulfur from 0 to 7 gram-atoms per mole of said sulfur compound, with a medium consisting of water or of a mixture of wter with aliphatic monoalcohol, (3) heating the resultant mixture and, after separation into two phases, recovering the olefin polysulfide in the organic phase, and (4) optionally treating the product obtained in step (3) with a basic compound such as an inorganic base.

In these prior patent applications it is stated that the prepared products are olefin polysulfides, whose sulfur content may reach about 45-65 % by weight. Their kinematic viscosity at 100° C. varies in relation with their sulfur content. It may be about 4-20 $mm^2/s$. Their halogen (mainly chlorine) content is generally lower than about 1% by weight and mostly than 0.6% by weight.

Their solubility in lubricating oils, particularly in hydrogenated polyalphaolefins (PAO) depends on the operating conditions used for their preparation.

U.S. Pat. No. 4,563,302 discloses a process which may also produce olefin polysulfides of increased solubility in polyalphaolefins (up to 8% per weight). This process comprises the following main steps of:

(1) reacting a sulfur halide such as sulfur monochloride $S_2Cl_2$, sulfur dichloride $SCl_2$ or a mixture of the two reactants, with an aliphatic olefin containing 3-6 carbon atoms, so as to obtain an addition product called an "adduct", (2) reacting said adduct with sulfur, sodium sulfide $Na_2S$, an alkyl mercaptan having 1-12 carbon atoms and optionally sodium hydrosulfide NaSH, in a hydroalcoholic medium within a temperature range from 50° C. to reflux temperature, so as to form said olefin sulfide, and (3) separating said olefin sulfide from the hydroalcoholic medium.

U.S. Pat. No. 3,873,454 discloses an extreme-pressure additive for lubricants obtained by reacting isobutylene with a sulfur halide so as to form an adduct which is then reacted with an alkali metal mercuptide in an inert medium, thus forming a compound of the formula:

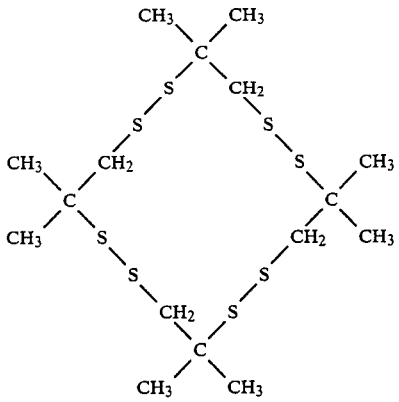

The alkali metal mercaptide may be sodium, potassium, lithium or calcium mercaptide. The reaction medium is generally a lower alcohol ($C_1$–$C_4$). The desired compound (having a sulfur content of about 53%) is obtained with a yield of about 45 % by weight, the remaining 55% consisting of a mixture of unsaturated sulfides and polysulfides.

In the unique example of preparation of the compound it is stated that a dispersion of solids is obtained by stirring a mixture of sodium mercaptide in ethanol, before adding the adduct, separately prepared.

The desired product is finally obtained as a solid, which is separated and purified.

However, such a compound is not soluble to a large extent in mineral oils and in synthetic oils of the polyalphaolefin type.

SUMMARY OF THE INVENTION

Now, it has been discovered that it is possible to prepare new (poly)sulfide compositions having a still increased or even complete solubility in mineral oils and synthetic lubricants, particularly of the hydrogenated polyalphaolefin type. These compositions are advantageously used as additives for lubricants, particularly for improving their extreme-pressure properties.

Generally, the olefin polysulfide compositions according to the invention may be defined as being obtained by a process comprising the following steps of:

(1) reacting at least one compound selected from sulfur monochoride and dichloride with at least one aliphatic monoolefin complying with the general formula $R^1—C(R_2)=CH_2$ wherein $R^1$ is a hydrogen atom or an alkyl radical having 1–3 carbon atoms and $R^2$ is a hydrogen atom or a methyl radical, so as to form an addition product or "adduct", (2) reacting, generally in an alcoholic medium, the addition product with at least one polysulfide complying with the general formula $R^3 S_x M$, wherein $R^3$ is an aliphatic radical containing, for example, 1 to 14 carbon atoms, which may comprise at least one functional group (e.g. at least one hydroxyl group), an aromatic radical, optionally substituted with one or more aliphatic radicals and containing, for example, 6 to 14 carbon atoms, or an heterocyclic radical containing at least one heteroatom selected from nitrogen, sulfur and oxygen, M is a monovalent atom or group corresponding to an inorganic base of general formula MOH, and x has an average value from at least 1.2 up to about 7 for example; and optionally (3) contacting the product of step (2) with an alkaline aqueous solution.

The aliphatic monoolefin involved in step (1) contains from 2 to 5 carbon atoms. Mostly isobutene ($R^1=R^2=CH_3$) is used. The proportion of monoolefin is more particularly from 1.5 to 2.5 moles per mole of sulfur mono- and/or dichloride. It is generally introduced in the liquid sulfur mono- and/or dichloride at 20°–80° C., more particularly 30°–50° C.

The addition product, or "adduct", obtained in step (1), consists of a mixture of sulfur compounds having an average sulfur content of about 1 to 2 gram-atoms per mole, depending on the use as starting product of sulfur dichloride, sulfur monochloride or a mixture thereof. The chloride content is about 2 gram-atoms per mole of product.

Polysulfides of general formula $R^3$-$S_xM$ involved in step (2) may be prepared by reacting, preferably in an alcoholic medium, at least one mercaptan of general formula $R^3$ SH with an inorganic base MOH, $R^3$ and M being defined as precedingly, then with elemental sulfur in such a proportion as to obtain an average value of x, in the formula of the obtained product, ranging from 1.2 to 7.

Examples of mercaptans of formula $R^3SH$ advantageously used to prepare polysulfides are: methylmercaptan, ethylmercaptan, n-propylmercaptan, n-butylmercaptan, isobutylmercaptan, tert-butylmercaptan, tert-nonylmercaptan, tert-dodecylmercaptan, mercaptoethanol, 3-mercapto 1,2-propanediol, phenylmercaptan, tolylmercaptans, as well as 2-mercaptobenzimidazole, 2-mercaptobenzothiazole, 2-mercaptobenzoxazole, 2-mercapto 1-methylimidazole, 2-(and 4)mercaptopyridines, 2-mercapto 3-pyrydinol, 2-mercaptothiazoline and 5-mercaptotriazole.

The reaction of mercaptan with the inorganic base is generally conducted at a temperature of 20°–100° C. The alcoholic medium may comprise at least one aliphatic monoalcohol containing for example 1 to 5 carbon atoms, mostly methanol. Generally 200 to 400 ml of aliphatic mono-alcohol are used per mole of mercaptan. With an inorganic base selected from sodium hydroxide, potassium hydroxide or ammonium hydroxide, the obtained corresponding product is a sodium, potassium or ammonium mercaptate of formula $R^3$-SM. (M representing Na, K or $NH_4$).

For preparing polysulfide, the so-formed $R^3SM$ is reacted with element sulfur used in a proportion of 0.2 to 10 gram-atoms per mole of mercaptate. This reaction is conducted at a temperature of 20°–100° C.

In step (2) the polysulfide of formula $R^3S_xM$ is reacted, preferably in an alcoholic medium, with the adduct obtained in step (1) which is generally added to the polysulfide alcoholic solution in an amount corresponding to a molar excess of about 0.1 to 70% with respect to the stoichiometry of 2 moles per mole of adduct, the reaction medium being maintained for example at a temperature in the range from −10 C. to the reflux temperature of the alcoholic solvent.

At the end of step (2) an olefin polysulfide composition is obtained which may be further treated in step (3) with an alkaline aqueous solution, more particularly a sodium or potassium hydroxide aqueous solution, at a concentration of, for example, about 1 to 50% by weight. The amount of alkaline solution may be, for example, from 0.1 to 5 times the weight of raw olefin polysulfide to be treated.

The olefin polysulfide compositions according to the invention may have a sulfur content of about 25–60% by weight. Their chorine content is generally lower than 0.1% by weight, mostly lower than 0.05% by weight. They can be advantageously used as extreme-pressure additives for lubricating oils.

The solubility of oils and the extreme-pressure properties can be adjusted by conveniently selecting the mercaptan and the amount of element sulfur in proportion to the mercaptan. Very often, a complete solubility is obtained.

A first application of olefin polysulfide compositions according to the invention concerns more particularly their use in oils for gear lubrication. The oil base may be of mineral or synthetic type.

Synthetic oils include in particular olefin oligomers such as tri-, tetra- and pentamers of 1-decene, obtained by oligomerization in the presence of LEWIS acids. Other α-olefins may also be used, for example $C_6$–$C_{14}$ α-olefins.

Alkylbenzenes such as mono- and dialkylbenzenes, or synthetic esters obtained with mono- or polycarboxylic acids (such as sebacic acid, fatty acids etc . . . ) and monoalcohols or polyols (such as 2-ethylhexanol, trimethylol-propane etc . . . ) may also be used.

The considered olefin polysulfides may then be added to the lubricating oils at concentrations ranging for example from 0.5 to 10% by weight.

These additives may be used in combination with phosphorus-containing additives, such as metal dialkyl- or diaryl dithiphosphates, organic phosphites and phosphates.

Other conventional additives such as antioxidants, antirust agents, copper deactivators, antifoam agents, friction reducers, may be added in usual proportions.

A second application of the olefin polysulfide compositions of the invention concerns their use as extreme-pressure additives for lubricants, particularly for lubricating oils destined to metal working (cutting, forming etc . . . ).

For this application the additive concentration is generally from 0.1 to 20%, preferably 0.5 to 5% by weight in proportion to the lubricating oil, and other conventional additives such as chlorinated paraffins may be added in amounts corresponding, for example, to 2–10% by weight of chlorine, in proportion to the lubricating oil.

EXAMPLES

The following examples are given to illustrate the invention and must not be considered as limiting the scope thereof. Example 4 is given for comparison purposes.

EXAMPLE 1

A 2 liter-reactor, provided with stirring means, is fed with 540 g of sulfur monochloride $S_2Cl_2$ (4 moles) and then with 506 g of isobutylene (9.74 moles) wherein 5 g of methanol were previously dissolved, introduced below the continuously stirred $S_2Cl_2$ surface, through a dip tube. The reaction medium temperature is maintained in the range of 45°–50° C. during the whole time of isobutylene introduction (1 hour). 1000 g of addition product, called "adduct" are thus obtained.

A second 2 liter-reactor, provided with stirring means, is fed with 1 liter of absolute methanol and 96g of sodium hydroxide pellets (2.4 moles). The mixture is heated to about 60° C., up to dissolution of sodium hydroxide. Then 216 g of tert-butyl-mercaptan (2.4 moles) are added dropwise into the alcoholic medium, while maintaining the temperature at about 60° C. After an additional half hour of reaction, 38.4 g of sulfur as flowers (1.2 gram-atom) are added to said homogeneous solution. The mixture is heated to reflux for 0.5 hour to favor the formation of a sodium polysulfide. The S/mercaptan molar ratio is 0.5/1.

Then 247 g (1 theoretical mole) of the previously prepared adduct are added dropwise through an addition funnel in 0.5 hour, the reaction temperature being determined by the methanol reflux temperature. The reaction is continued during 8-hours at reflux and then methanol is distilled.

The residual mixture is washed twice with 500 $cm^3$ of water. The recovered olefin polysulfide is treated at reflux, under vigorous stirring, with 180 g of a 10% by weight sodium hydroxide aqueous solution. After washing with water, the recovered olefin polysulfide is dried over anhydrous sodium sulfate, filtered and evaporated under reduced pressure at 100° C., up to constant weight. It appears as a light mobile oil having the following physico-chemical characteristics:

S=43.9% by weight; Cl<0.05% by weight; $\nu_{100°}$ C. =2.25 $mm^2/s$. Complete solubility in mineral oils at 20° C. and −5° C. Complete solubility in PAO (hydrogenated polyalphaolefin) oil SAE 90 at 20° C. and −5° C.

EXAMPLE 2

Example 1 is repeated in the same operating conditions but with 76.8 g of flowers of sulfur (2.4 gram-atoms), the S/mercaptan molar ratio being thus 1/1.

After reaction and treatments, the olefin polysulfide is recovered as a fluid oil having the following physico-chemical characteristics:

S=47.91% by weight; Cl<0.05% by weight; $\nu_{100°}$ C. =2.72 $mm^2/S$.

Complete solubility in mineral oils at 20° C. and −5° C.

Complete solubility in SAE 90 PAO oils at 20° C. and −5° C.

EXAMPLE 3

Example 1 is repeated in the same operating conditions but with 384 g of tert-nonylmercaptan (2.4 moles) and 384 g of sulfur as flowers (12 gram-atoms). The S/mercaptan molar ratio is then about 5/1. After reaction and without treatment with a sodium hydroxide aqueous solution, a fluid oil is recovered whose characteristics are as follows:

S=53.9% by weight; Cl=0.07% by weight; $\nu_{100°}$ C. =6.2 $mm^2/s$. Solubility in 100 Neutral Solvent oil : soluble up to a proportion of about 20 % by weight at 20° C.

EXAMPLE 4 (comparison)

Example 1 is again repeated but without using elemental sulfur.

The physico-chemical characteristics of the obtained product are as follows:

S=36.0% by weight; Cl<0.3% by weight; $\nu_{100°}$ C. =2.1 $mm^2/s$.

Complete solubility in mineral oils and in PAO at 20° C. and −5° C.

EXAMPLE 5

Estimation of the extreme-pressure properties of the additives according to the invention.

Tests have been conducted for showing the extreme-pressure properties of additives prepared according to some of the preceding examples, respectively with compositions of the gear-oil type and compositions of the metal-working oil type.

The additives of examples 1 and 2 have been tested with a 4-ball E.P. tester according to the procedure defined in Standard ASTM D 2266 and D 2783, in a SAE 90 PAO synthetic oil at concentrations corresponding to a 0.69% by weight sulfur content of the oil.

The results are summarized in table 1 hereinafter:

TABLE 1

| Additive of example | S contained in the additive (% b.w) | S in oil (% b.w) | load/ wear index | Welding load (N) | Print Ø of balls - 1 h under 292 N (mm) |
|---|---|---|---|---|---|
| — | 0 | 0 | 21.8 | 588 | 0.85 |
| 1 | 43.9 | 0.69 | 63.8 | 3923 | 0.65 |
| 2 | 47.9 | 0.69 | 65.2 | 3923 | 0.65 |

These results show that the additives according to the invention lead to a very substantial increase of the load/wear index and substantially reduce the wear of the balls. This type of additive is advantageously used in the composition of extreme-pressure oils for industrial or car gears and in the composition of non-ferrous metal-working oils.

EXAMPLE 6

The extreme-pressure properties of the additive obtained in example 3 are estimated from a composition of metal-cutting oil, by means of a 4-ball E.P. tester, according to the procedure of ASTM D 2783.

The lubricant composition consists of a 100 Neutral Solvent oil containing 3% of chlorine as chlorinated paraffin and 1% of sulfur as sulfur-containing additive of example 2.

The results are summarized in table 2 hereinafter.

From these results, it appears that the additive is used very satisfactorily in an oil composition for ferrous metal working.

TABLE 2

| | | | | |
|---|---|---|---|---|
| Chlorinated paraffin (% by weight) | none | 4.62 | none | 4.62 |
| Additive of example | none | none | 3 | 3 |
| S % by weight in the sulfur-containing additive | — | — | 53.9 | 53.9 |
| Additive % by weight in 100 N.S. oil | — | — | 1.86 | 1.86 |
| Solubility in 100 N.S. oil | | | | |
| 20° C. | — | limpid | limpid | limpid |
| 0° C. | — | limpid | limpid | limpid |
| 4 - ball E.P. tests | | | | |
| load/wear index | 21.7 | 39.2 | 46.0 | 100.1 |
| load before seizure (N) | 490 | 785 | 785 | 981 |
| welding load (N) | 126 | 200 | 315 | 620 |

What is claimed as the invention is:

1. An olefin polysulfide composition obtained by a process comprising the steps of:

(1) reacting at least one compound selected from sulfur monochoride and dichloride with at least one aliphatic monoolefin having 2 to 5 carbon atoms, complying with the formula $R^1—C(R^2)=CH_2$, wherein $R^1$ is a hydrogen atom or an alkyl radical having from 1 to 3 carbon atoms and $R^2$ is a hydrogen atom or a methyl radical, so as to form an addition product, and (2) reacting said addition product with at least one polysulfide complying with general formula $R^3S_xM$, wherein $R^3$ represents an aliphatic radical, optionally carrying a functional group, an aromatic radical, optionally substituted with at least one aliphatic radical, or an heterocyclic radical, M is a monovalent atom or group corresponding to an inorganic base of formula MOH, and x has an average value of at least 1.2.

2. A composition according to claim 1, wherein, in step (1), said aliphatic monoolefin is used in a proportion of 1.5–2.5 moles per mole of sulfur mono- and/or dichloride.

3. A composition according to claim 1, wherein said aliphatic monoolefin is isobutene.

4. A composition according to claim 1, wherein, in the formula $R^3S_xM$ of the polysulfide used in step (2), $R^3$ represents an aliphatic radical having from 1 to 14 carbon atoms, an aliphatic radical having at least one hydroxyl group, an aromatic radical optionally substituted wtih at least one aliphatic radical having 6–14 carbon atoms or an heterocyclic radical containing at least one heteroatom selected from nitrogen, sulfur and oxygen, M represents a sodium or potassium atom or an ammonium group and x has an average value of 12 to about 7.

5. A composition according to claim 1, wherein step (2) is performed in the presence of an aliphatic monoalcohol having from 1 to 5 carbon atoms, used in a proportion of 200 to 400 ml per mole of polysulfide $R^3S_xM$.

6. A composition according to claim 1, wherein the polysulfide $R^3S_xM$ used in step (2) is obtained by a process wherein at least one mercaptan of general formula $R^3SH$ is reacted with an inorganic base MOH, then with a sufficient amount of elemental sulfur to produce said polysulfide.

7. A composition according to claim 6, wherein about 0.2-10 gram-atoms of element sulfur is used per mole of mercaptan.

8. A composition according to claim 6, wherein the inorganic base is sodium hydroxide, potassium, hydroxide or ammonium hydroxide, the operation being conducted within an aliphatic monoalcohol of 1–5 carbon atoms, at a temperature from 20° to 100° C.

9. A composition according to claim 1, wherein step (1) is conducted at a temperature from 20° to 80° C., and step (2) is performed within an aliphatic monoalcohol of 1–5 carbon atoms, used in a proportion of 200–400 ml per mole of polysulfide $R^3S_xM$ said polysulfide being used in molar excess of about 0.1 to 70% in proportion to the stoichiometry of 2 moles per mole of said addition product, said reaction medium being maintained at a temperature from −10° C. to the reflux temperature of said monoalcohol.

10. A composition according to claim 1 produced by a process further comprising a step (3) wherein the product obtained at the end of step (2) is contacted with an aqueous solution of inorganic base.

11. A composition according to claim 10, wherein in step (3) an aqueous solution of sodium hydroxide or potassium hydroxide at a concentration of 0.1 to 50% by weight, in a proportion of 0.1 to 5 times the amount by weight of the resultant product from step (2).

12. A process for preparing an olefin polysulfide composition comprising (1) reacting at least one compound selected from sulfur monochloride and dichloride with at least one aliphatic monoolefin having 2 to 5 carbon atoms, complying with the formula $R^1—C(R^2)=CH_2$, wherein $R^1$ is a hydrogen atom or an alkyl radical having 1 to 3 carbon atoms and $R^2$ is a hydrogen atom or a methyl radical, so as to form an addition product, and (2) reacting said addition product with at least one polysulfide complying with general formula $R^3S_xM$, wherein $R^3$ represents an aliphatic radical, optionally carrying a functional group, an aromatic radical, optionally substituted with at least one aliphatic radical, or an heterocyclic radical, M is a monovalent atom or group corresponding to an inorganic base of formula MOH, and x has an average value of at least 1.2.

13. A gear-oil composition comprising a major proportion of a mineral or synthetic lubricating oil and, as an additive, 0.5–10% by weight, with respect to said lubricating oil, of at least one olefin polysulfide composition according to claim 1.

14. A metal working oil composition comprising a major proportion of oil and, as an additive, 0.1–20% by weight, with respect to said oil, of at least one olefin polysulfide composition according to claim 1.

15. A composition according to claim 6, wherein the elemental sulfur is used in an amount sufficient to obtain an average value of x in the polysulfide $R^3S_xM$ of 1.2–7.

* * * * *

UNITED STATES PATENT AND TRADEMARK OFFICE

CERTIFICATE OF CORRECTION

PATENT NO. : 4,839,069

DATED : June 13, 1989

INVENTOR(S) : Born et al

It is certified that error appears in the above-identified patent and that said Letters Patent is hereby corrected as shown below:

TITLE PAGE, FOREIGN PRIORITY INFORMATION WAS NOT LISTED:

Should Read:--France 86/14.576 October 17, 1986--

Signed and Sealed this

Twentieth Day of March, 1990

*Attest:*

JEFFREY M. SAMUELS

*Attesting Officer*

*Acting Commissioner of Patents and Trademarks*